US008038264B2

(12) United States Patent
Sugahara

(10) Patent No.: US 8,038,264 B2
(45) Date of Patent: Oct. 18, 2011

(54) LIQUID DROPLET JETTING HEAD

(75) Inventor: Hiroto Sugahara, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 275 days.

(21) Appl. No.: 12/341,596

(22) Filed: Dec. 22, 2008

(65) Prior Publication Data

US 2009/0167821 A1 Jul. 2, 2009

(30) Foreign Application Priority Data

Dec. 29, 2007 (JP) ..... 2007-341562

(51) Int. Cl.
*B41J 2/045* (2006.01)

(52) U.S. Cl. ..... 347/68; 347/71; 347/72

(58) Field of Classification Search ..... 347/70, 347/71

See application file for complete search history.

(56) References Cited

U.S. PATENT DOCUMENTS

2004/0114004 A1* 6/2004 Taira ..... 347/87
2004/0160494 A1* 8/2004 Isono et al. ..... 347/68

FOREIGN PATENT DOCUMENTS

JP 2-146030 12/1990
JP 2004-114505 4/2004

* cited by examiner

*Primary Examiner* — Matthew Luu
*Assistant Examiner* — Lisa Solomon
(74) *Attorney, Agent, or Firm* — Frommer Lawrence & Haug LLP

(57) ABSTRACT

A plurality of pressure chambers are divided into a first pressure chamber group and a second pressure chamber group, and are arranged such that an interval of the first pressure chamber group and the second pressure chamber group is larger than an interval between nozzles, and sub ink supply passage which supplies the ink to the common liquid chambers through the space is formed. Accordingly, a liquid droplet jetting head which is capable of delivering the ink to all the nozzles without increasing a size is provided.

13 Claims, 14 Drawing Sheets

LIQUID DROPLET JETTING HEAD

CROSS REFERENCE TO RELATED APPLICATION

The present application claims priority from Japanese Patent Application No. 2007-341562, filed on Dec. 29, 2007, the disclosures of which are incorporated herein by reference in its entirety.

BACKGROUND OF THE INVENTION

1. Field of the Invention

The present invention relates to a liquid droplet jetting head which is used in a liquid droplet jetting apparatus.

2. Description of the Related Art

As a liquid droplet jetting head, an ink-jet head which transports an ink supplied from an ink tank, and jets ink droplets from nozzles toward a recording paper has already been known. Types for jetting ink is classified according to a difference of a method of generation of a jetting energy. For example, there are types such as a thermal-jet type in which ink droplets are jetted by generating an air bubble by thermal (heat) energy.

The liquid droplet jetting head described above, includes for example, a channel unit in which a plurality of nozzles, a plurality of pressure chambers which communicate with the plurality of nozzles, a common liquid chamber which communicates with the plurality of pressure chambers, and an ink supply channel for supplying the ink to the common liquid chamber from an outside are formed, and a pressure applying mechanism which applies a jetting pressure to the ink which is infused into the plurality of pressure chambers. The nozzles form a nozzle group which is arranged in rows at an equal interval in a predetermined direction, and the pressure chambers are arranged in a row corresponding to the nozzle group. Moreover, the common liquid chamber is formed to be extended in the predetermined direction corresponding to the pressure chambers arranged in a row, and an ink supply channel which infuses the ink is provided at an end portion of the common liquid chamber (for example, refer to Japanese Patent Application Laid-open No. 2004-114505).

SUMMARY OF THE INVENTION

However, in the liquid droplet jetting head described in Japanese Patent Application Laid-open No. 2004-114505, it can be considered that the nozzle row and common liquid chamber is elongated for increasing the number of nozzles. In this case, since the ink supply channel is formed at the end portion of the common liquid chamber, a problem that the ink can not reach all the nozzles may arise. For solving this problem, it can be considered that a width of the common liquid chamber is widened to flow a large amount of ink into the common liquid chamber. However, when the width of the common liquid chamber is widened, a size of the head becomes large.

The present invention is made in view of the abovementioned problems in the conventional technology, and an object of the present invention is to provide a liquid droplet jetting head which is capable of carrying (transporting) the ink to all the nozzles without the size of the head being increased.

To achieve the abovementioned object, the following technological means have been considered in the present invention.

According to a first aspect of the present invention, there is provided a liquid droplet jetting apparatus which jets droplets of a liquid, including:

a channel unit having:

a plurality of nozzles which are formed in the channel unit and which form a nozzle group arranged in a row in a first direction at a first interval;

a plurality of pressure chambers which are formed in the channel unit, each of which communicates with one of the nozzles and which form a first pressure chamber group and a second pressure chamber group, the first pressure chamber group including a first pressure chamber which is positioned nearest to the second pressure chamber group, the second pressure chamber group including a second pressure chamber which is positioned nearest to the first pressure chamber group, and the plurality of pressure chambers being arranged in a row in the first direction such that a gap between the first pressure chamber and the second pressure chamber is larger than the first interval;

a common liquid chamber which is formed in the channel unit, which communicates with the plurality of pressure chambers, and which is extended in the first direction corresponding to the plurality of pressure chambers arranged in the row;

a liquid supply passage which supplies the liquid to the common liquid chamber from outside of the channel unit; and an auxiliary supply passage which supplies the liquid to the common liquid chamber through the gap, and a pressure applying mechanism which applies a jetting pressure to the liquid in the plurality of pressure chambers.

According to the first aspect of the present invention, the two pressure chamber groups are arranged in a row such that the space between the first pressure chamber included in the first pressure chamber group, which is positioned nearest to the second pressure chamber group, and a second pressure chamber included in the second pressure chamber group which is positioned nearest to the first pressure chamber group is larger than the first interval, and the auxiliary supply passage which supplies the ink to each common liquid chamber through the space is formed. Therefore, it is possible to supply a liquid such as ink even from a half-way portion of each common liquid chamber through the auxiliary supply passage. Accordingly, even in a head including a large number of nozzles in which the nozzle row is elongated, it possible to deliver sufficiently a liquid such as ink to all the nozzles.

In the liquid droplet jetting head of the present invention, the pressure applying mechanism may be a piezoelectric actuator which changes a volume of each of the pressure chambers independently, and which is joined to a surface of the channel unit; and the auxiliary supply passage may be a sub supply passage which penetrates through the piezoelectric actuator to reach the common liquid chamber.

In this case, it is possible to supply a substantial amount of liquid such as ink to the common liquid chamber through the ink supply passage (main ink supply passage) and the sub ink supply passage.

In the liquid droplet jetting head of the present invention, the channel unit may include a plurality of first walls each separating two adjacent pressure chambers among the pressure chambers, a second wall separating the sub supply passage and the first pressure chamber, and a third wall separating the sub supply passage and the second pressure chamber; and a thickness of each of the first walls, a thickness of the second wall, and a thickness of the third wall may be same.

In this case, a change in a volume of the first pressure chamber and the second pressure chamber adjacent to the sub ink supply tank, and a change in a volume of the other pressure chambers become equal, and it is possible to achieve uniform jetting performance.

In the liquid droplet jetting head of the present invention, the nozzle group may be formed as a plurality of nozzle groups, and the plurality of nozzle groups are arranged at an interval in a second direction orthogonal to the first direction;

the common liquid chamber, the first pressure chamber group, the second pressure chamber group, and the sub supply passage may be formed as a plurality of common liquid chambers, a plurality of first pressure chamber groups, a plurality of second pressure chamber groups, and a plurality of sub supply passages, respectively, corresponding to the plurality of nozzle groups; and a positional relationship among one of the sub supply passages, a first pressure chamber group among the plurality of the first pressure chamber groups, and a second pressure chamber group among the plurality of the second pressure chamber groups which are adjacent to the one of the sub supply passages, may be same for all of the sub supply passages. In this case, it is possible to make constant an amount of ink delivered to the plurality of nozzles in each nozzle group.

In the liquid droplet jetting head of the present invention, the piezoelectric actuator may include a plurality of electric power supply terminals corresponding to the plurality of pressure chambers respectively; and the liquid droplet jetting head may further include a flexible wire which includes a plurality of terminal electrodes which are connected to the plurality of electric power supply terminals respectively, and through which a driving electric power is supplied to the piezoelectric actuator; and an opening which maintains the sub supply passage to be opened may be formed in the flexible wire at a position at which the opening overlaps with the sub supply passage.

In this case, it is possible to avoid interference between the sub supply passage and the flexible wire.

In the liquid droplet jetting head of the present invention, the piezoelectric actuator may include a plurality of internal drive electrodes corresponding to the plurality of pressure chambers respectively, and a plurality of wires which are formed inside the piezoelectric actuator, and through which a driving electric power is supplied to the internal drive electrodes; and the plurality of wires may be extended in an area at which the sub supply passage is absent.

In this case, it is possible to avoid interference between the sub supply passage and the plurality of wires formed inside the piezoelectric actuator.

In the liquid droplet jetting head of the present invention, the nozzle group may be formed as a plurality of nozzle groups arranged to be separated and away from each other in a second direction orthogonal to the first direction;

the common liquid chamber, the first pressure chamber group, and the second pressure chamber group may be formed as a plurality of common liquid chambers, a plurality of first pressure chamber groups, and a plurality of second pressure chamber groups, respectively, corresponding to the nozzle groups; and the auxiliary supply passage may be a communicating passage via which two common liquid chambers among the common liquid chambers are communicated.

In this case, since the common liquid chambers communicate mutually, a mid-way portion of the common liquid chamber is connected, and it is possible to deliver a liquid such as ink to each common liquid chamber.

In the liquid droplet jetting head of the present invention, two adjacent nozzle groups in the second direction, among the nozzle groups, may be arranged to be shifted from each other in the first direction; and two common liquid chambers among the common liquid chambers and corresponding to the two nozzle groups may be communicated via the communicating passage, and the communicating passage may have an inclined passage corresponding to the shift in the first direction, between the nozzle groups.

Moreover, a positional relationship among the communicating passage, one first pressure chamber group which belongs to the first pressure chamber groups and which corresponds to the communicating passage and one nozzle group of the nozzle groups, and one second pressure chamber group which belongs to the second pressure chamber groups, which is located adjacent to the one first pressure chamber group, and which corresponds to the communicating passage and the one nozzle group, may be same for all of the nozzle groups. In this case, it is possible to make constant an amount of a liquid such as ink, which is delivered to the plurality of nozzles in each nozzle group.

In the liquid droplet jetting head of the present invention, an interval between two adjacent pressure chambers among the pressure chambers belonging to the first pressure chamber group or the second pressure chamber group may be narrower than the first interval. In this case, it is possible to secure a sufficient area for providing the auxiliary supply passage in the space.

In the liquid droplet jetting head of the present invention, the channel unit may be elongated in the first direction. Moreover, the pressure chambers may be arranged in a plane direction in the channel unit, the piezoelectric actuator may be arranged to entirely cover the pressure chambers in the plane direction; and the sub supply passage may extend in a direction crossing the plane direction and may be introduced to the common liquid chamber from a side, of the piezoelectric actuator, not facing the channel unit.

In the liquid droplet jetting head of the present invention, the channel unit may include a nozzle plate in which the nozzles are formed, and a cavity plate in which the pressure chambers are formed; and the nozzle plate, the cavity plate and the pressure applying mechanism may be stacked in this order. Moreover, the pressure chambers and the common liquid chamber may be arranged between the nozzles and the pressure applying mechanism.

As it has been described above, according to the present invention, since it is possible to supply the ink from the half-way portion of the common liquid chamber through the auxiliary supply passage, it is possible to deliver sufficiently a liquid such as ink to all the nozzles without making large (without an increase in) a size of the liquid droplet jetting head.

DETAILED DESCRIPTION OF THE PREFERRED EMBODIMENTS

First Embodiment

Figure 1:
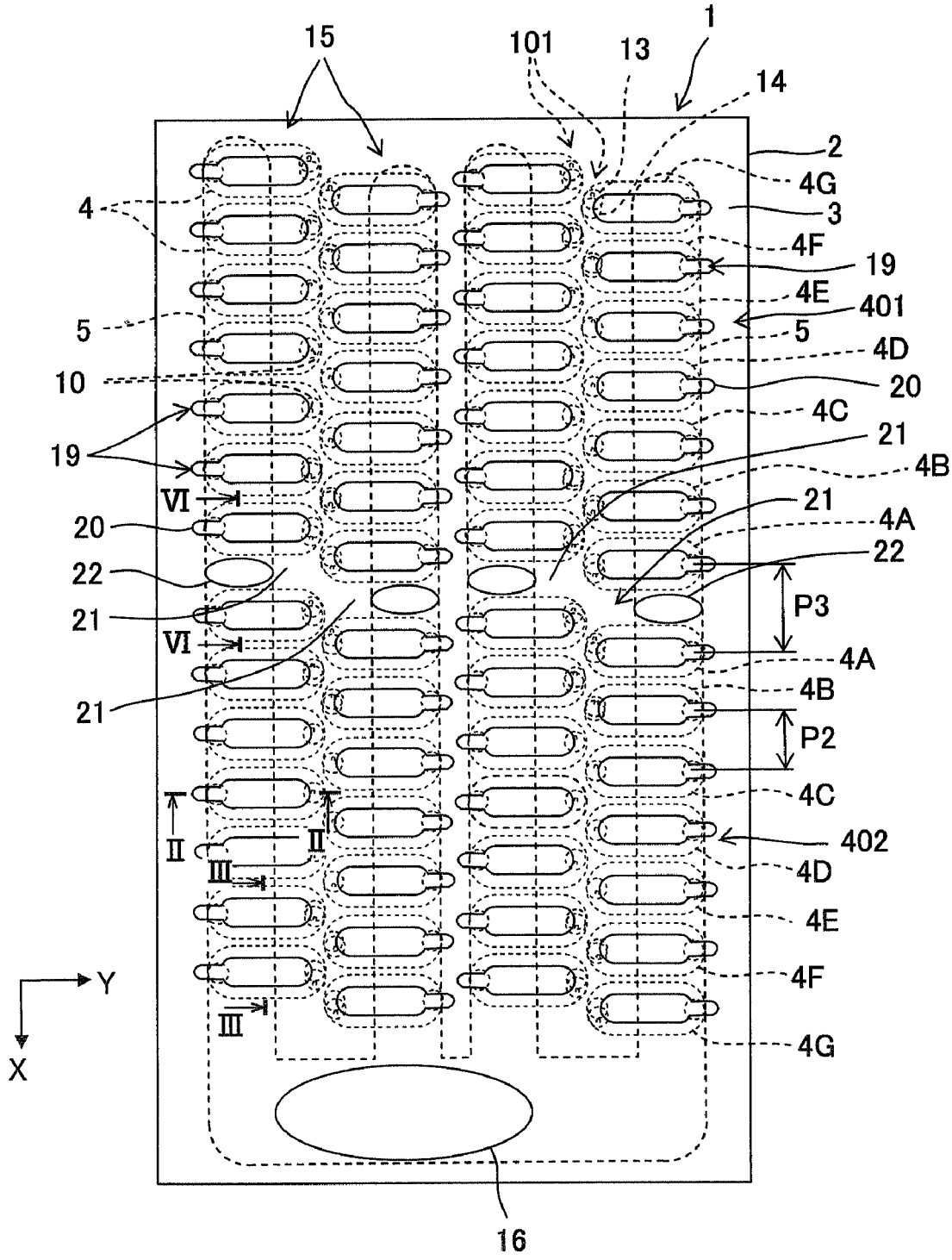
FIG. 1 is a plan view when a liquid droplet jetting head according to a first embodiment of the present invention is seen from a top.

Exemplary embodiments of the present invention will be described below with reference to the accompanying diagrams. FIG. 1 is a plan view showing a head 1 (a liquid droplet jetting head, an ink-jet head) according to a first embodiment of the present invention as viewed from a top. The head 1 includes mainly a channel unit 2 in which a plurality of substantially rectangular shaped plates are stacked, and a piezoelectric actuator 3 (pressure applying mechanism) which is joined to the channel unit 2. Moreover, a flexible circuit board not shown in the diagram is joined to an upper surface of the piezoelectric actuator 3. A drive circuit which outputs a driving signal for the piezoelectric actuator 3 is arranged on the flexible circuit board. In the following description, as shown by arrows in FIG. 1, a longitudinal direction of the head 1 is defined as X direction and a direction of a short side (a direction orthogonal to the longitudinal direction) is defined as Y direction.

The head 1 is provided to an ink-jet printer 100 (liquid droplet jetting apparatus) which performs recording and printing by ink-jet method on a recording medium such as a recording paper. The ink-jet printer 100 is provided with a carriage which is reciprocatable in a predetermined scanning direction (Y direction in FIG. 1), and the head 1 is mounted on the carriage. The head 1 carries out recording on a recording medium by jetting an ink toward the recording medium while reciprocating in the scanning direction together with the carriage.

Figure 2:
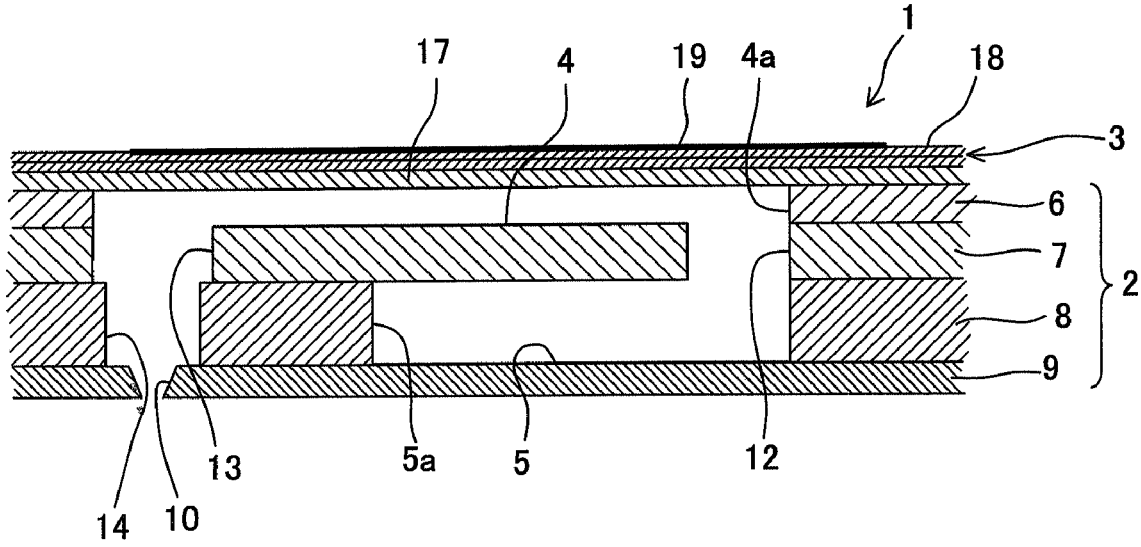
FIG. 2 is a cross-sectional view taken along a line II-II in FIG. 1.
Figure 3:
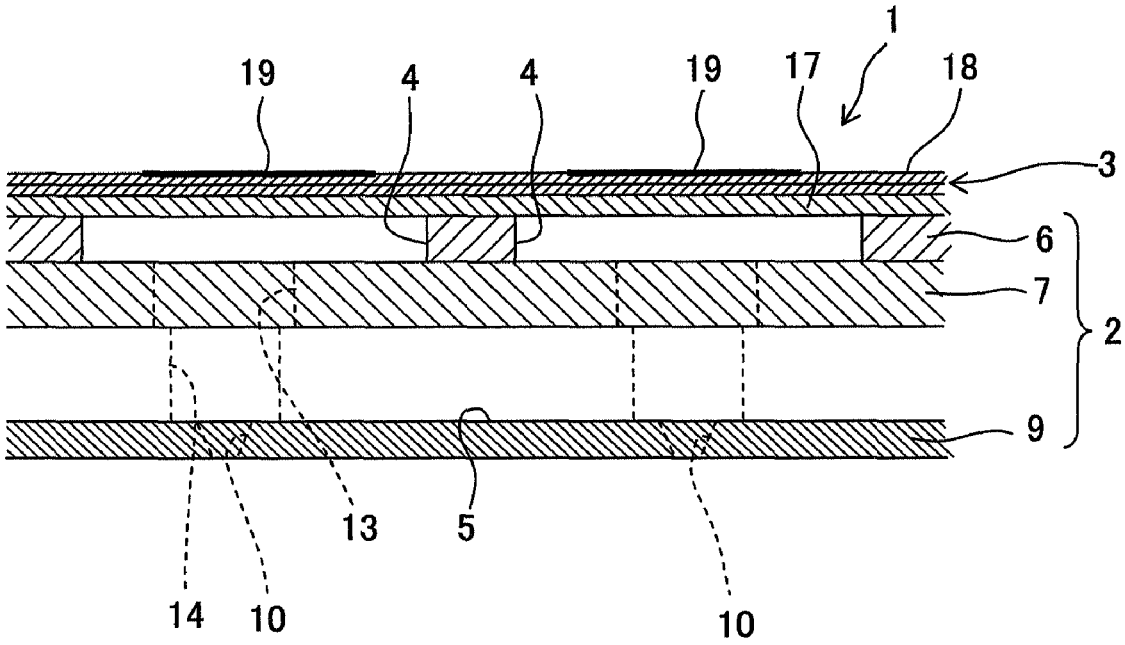
FIG. 3 is a cross-sectional view taken along a line III-III in FIG. 1.
Figure 4:
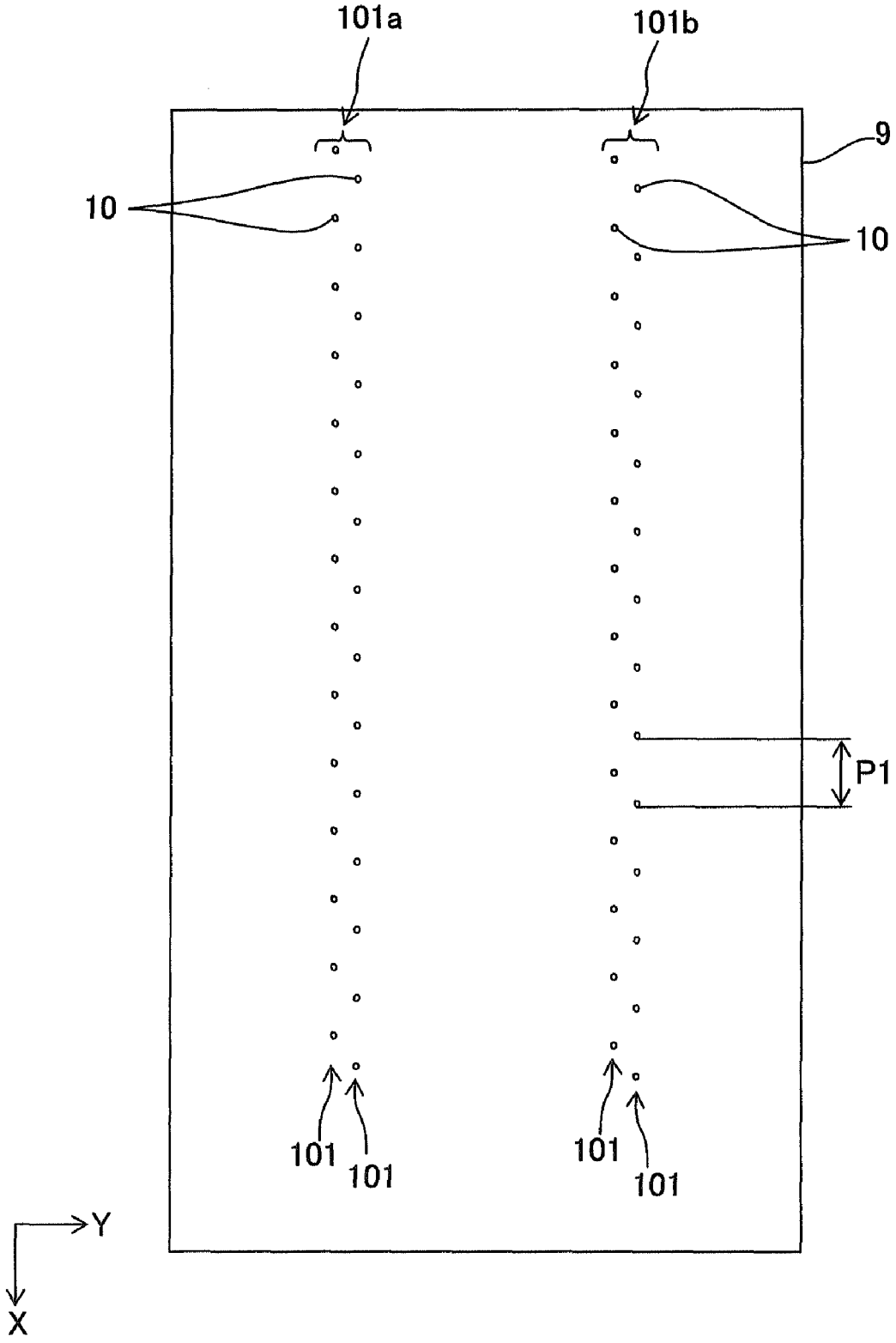
FIG. 4 is a plan view when a head 1 is seen from a bottom.

FIG. 2 is a cross-sectional view taken along a line II-II in FIG. 1. FIG. 3 is a cross-sectional view taken along a line III-III in FIG. 1. FIG. 4 is a plan view when the head 1 is viewed from a bottom. The channel unit 2 includes a cavity plate 6, a base plate 7, a manifold plate 8, and a nozzle plate 9 (hereinafter, plates 6 to 9), and these plates are stacked in the abovementioned order and adhered mutually. Each of the plates 6 to 9 is rectangular shaped having substantially the same dimensions in a plan view.

The nozzle plate 9 is formed of a synthetic resin material such as polyimide, and the other plates 6 to 8 are formed of 42% nickel alloy steel. Each of the plates 6 to 9 has a rectangular shape in a plan view, and has a thickness of about 50 μm to 150 μm. Holes and/or grooves are formed in each of the plates 6 to 9 by a method such as an electrolytic etching, a laser machining, and a plasma jet machining.

As shown in FIG. 4, two nozzle row groups 101*a* and 101*b* arranged at an interval in Y direction (left-right direction) are formed in the nozzle plate 9. The nozzle row group 101*a* is arranged at a left side of the nozzle plate 9, and the nozzle row group 101*b* is arranged at a right side of the nozzle plate 9. Each nozzle row group 101*a* and 101*b* has two nozzle rows (nozzle groups) 101 extended in X direction (a predetermined direction, nozzle row direction), and each nozzle row 101 includes a plurality of nozzles 10 having a fine diameter, through which an ink is jetted. A plurality of nozzles in the two nozzle rows 101 of the each nozzle row group 101*a* and 101*b* are arranged in a zigzag form along X direction. Moreover, in each nozzle row 101, the nozzles 10 are arranged at a same interval which is a first interval P1 along X direction. Typically, the first interval P1 is about 0.5 mm.

Moreover, a plurality of pressure chamber holes 4*a* which is to be a plurality of pressure chambers 4 are formed as through holes penetrating the cavity plate 6 in a thickness direction thereof. Four rows of the pressure chambers 4 at an interval in Y direction are arranged corresponding to the nozzles 10, and in each row, a plurality of pressure chambers 4 are arranged in a row along X direction. Each pressure chamber 4 is elongated in Y direction in a plan view, and is arranged such that, a longitudinal direction (Y direction) thereof is directed in X direction orthogonal to the row of nozzles 10.

A first connecting passage 12 which communicates with one end portion of the pressure chamber 4 and a common liquid chamber 5 which will be described later, and a second connecting passage 13 which makes the other end portion of the pressure chamber 4 communicate with the nozzle 10 are formed in the base plate 7. A common liquid chamber hole 5*a* which is to be the common liquid chamber 5 is formed by cutting through the manifold plate 8, and a third connecting passage 14 which makes communicate the second connecting passage 12 and the nozzle 10 is cut through the manifold plate 8. As shown in FIG. 1, the four common liquid chambers 5 are formed to be extended in X direction corresponding to rows of the pressure chambers 4 respectively. The plates 6 to 9 are stacked to form a channel 15 through which the ink circulates. According to the abovementioned structure, the ink supplied from an ink supply source (not shown in the diagram) is guided to the nozzle 10 upon flowing through the common liquid chamber 5 and the pressure chamber 4.

A through hole which forms a main ink supply passage 16 (ink supply passage) is formed at one end portion in a longitudinal direction in each of the plates 6 to 8 (from the cavity plate 6 to the manifold plate 8), and the main ink supply passage is formed by positioning these through holes in a vertical direction (refer to FIG. 1). The main ink supply passage 16 communicates with one end of the four common liquid chambers 5, and the ink is supplied from the ink supply source (not shown in the diagram) to the main ink supply passage 16.

The piezoelectric actuator 3 selectively changes a volume inside the pressure chambers 4. For example, as shown in FIG. 2, the piezoelectric actuator 3 includes a vibration plate 17 which is rectangular shaped, a plurality of stacked piezoelectric layers 18 each having a substantially same rectangular shape in a plan view, a plurality of surface electrodes 19 which are formed on an uppermost surface of the piezoelectric layers 18, and a common electrode and an internal electrode which are not shown in the diagram, and which are provided between the piezoelectric layers 18. The piezoelectric actuator 3 is joined to the channel unit 2 such that each of the surface electrodes 19 overlaps with one of the pressure chambers 4 of the channel unit 3 in a stacking direction thereof.

As shown in FIG. 1, each of the surface electrodes 19 is formed to be slightly smaller than one of the pressure chambers 4 in a plan view, and is formed to be elongated in Y direction, and is arranged in a row corresponding to one of the pressure chambers 4. Moreover, regarding the surface electrodes 19 arranged in two rows on both sides (Y direction) in left-right direction in FIG. 1 corresponding to the nozzle row groups 101*a* and 101*b*, the surface electrodes 19 in each row are arranged to be shifted mutually in X direction. An electrode terminal 20 (power supply terminal) for connecting to a terminal electrode of the flexible circuit board (not shown in the diagram) is provided at one end portion of each of the surface electrodes 19 in a longitudinal direction thereof.

A driving electric power is supplied to each of the internal electrodes via one of the electrode terminals 20 and one of the surface electrodes 19. Moreover, an area, of the piezoelectric layers, sandwiched between the internal electrodes and the common electrode is polarized in a thickness direction thereof in advance. Therefore, the area functions as an active portion which exhibits a piezoelectric effect. Concretely, when a drive circuit selectively applies driving electric power to the internal electrode based on a printing data, the active portion is deformed to be extended in the polarization direction. Accordingly, a volume of the pressure chamber 4 overlapping with the corresponding internal electrode in the stacking direction becomes small, and a pressure is applied to the ink in the pressure chamber 4. Accordingly, the ink is jetted as ink droplets from the nozzle 10, to an outside of the channel unit 2.

As shown in FIG. 1, in the channel unit 2, four pressure chamber rows arranged at a distance in Y direction are formed corresponding to four nozzle rows 101. The plurality of pressure chambers 4 in each of the pressure chamber rows are arranged in X direction (predetermined direction). Each of the pressure chamber rows is divided into a plurality of pressure chamber groups (two pressure chamber groups in FIG. 1) by a sub ink supply passage 22 which will be described later. In other words, the plurality of pressure chamber groups are arranged to form a row. In other words, the pressure chambers 4 corresponding to each of the nozzle groups 101 form a first pressure chamber group 401 arranged on one side of the sub ink supply passage 22 and a second pressure chamber group 402 arranged on the other side thereof. In the embodiment, the pressure chamber rows corresponding to the nozzle rows 101 each include the first pressure chamber group 401 and the second pressure chamber group 402.

In each of the pressure chamber rows corresponding to one of the nozzle rows 101 of the first embodiment, the first pressure chamber group 401 and the second pressure chamber group 402 each have seven pressure chambers from a first pressure chamber 4A (inner end pressure chamber) to a seventh pressure chamber 4G. An interval (distance) P2 between the adjacent pressure chambers 4 out of the pressure chambers 4 belonging to each of the first pressure chamber group 401 and the second pressure chamber group 402, is narrower than the first interval P1 between the nozzles 10. Typically, the interval P2 is about 0.3 to 0.5 mm.

A space 21 is formed between the adjacent first pressure chamber group 401 and the second pressure chamber group 402. In other words, an interval P3 between a pressure chamber 4A (first pressure chamber) in the first pressure chamber group 401, positioned nearest to the second pressure chamber group 402, and a pressure chamber 4A (second pressure chamber) in the second pressure chamber group 402, positioned nearest to the first pressure chamber group 401, is larger than the first interval P1 between the nozzles 10. Typically, the interval P3 is about 0.6 to 1.0 mm. That is, a space 21 as described below is about 0.3 to 0.5 mm.

Figure 5:
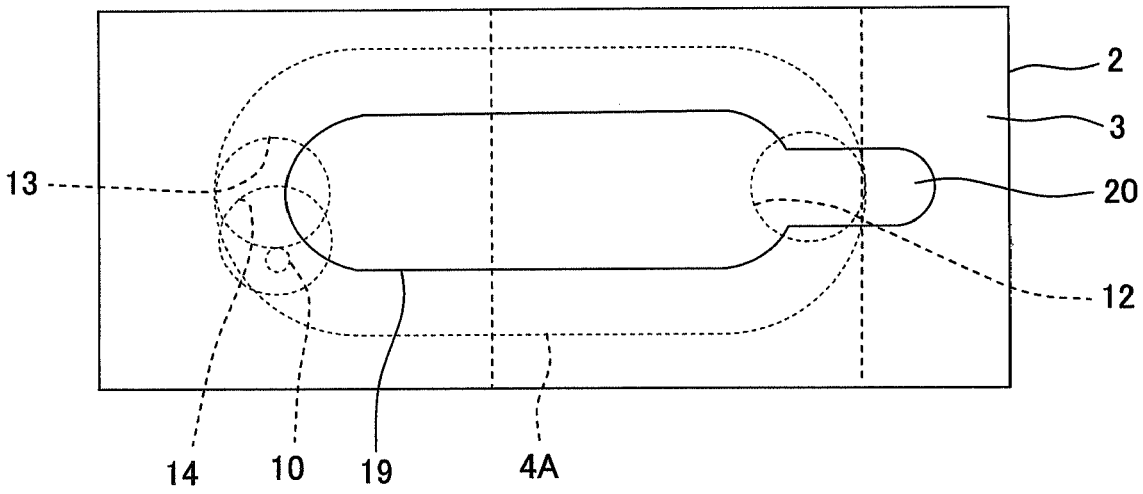
FIG. 5 is a plan view of a portion corresponding to a first common liquid chamber in FIG. 1.

In FIG. 1, the first pressure chamber group 401 and the second pressure chamber group 402 are formed symmetrically, with a central portion in X direction as a symmetrical axis. An arrangement of the pressure chambers 4 in the first pressure chamber group 401 and the second pressure chamber group 402 will be described below citing an example of the first pressure chamber group 401 (also refer to FIG. 5). In the following description, a position of a pressure chamber etc. means a position in X direction, and an upper/lower side means an upper/lower side in FIG. 1, respectively.

The fourth pressure chamber 4D from an inner side is formed at a position same as of the corresponding nozzle 10. The third pressure chamber 3C is somewhat shifted (misaligned) upward with respect to the corresponding nozzle 10, and a second pressure chamber 4B is further shifted with respect to the corresponding nozzle 10. Moreover, the first pressure chamber 4A is further shifted upward than the second pressure chamber 4B with respect to the corresponding nozzle 10.

Each of the second connecting passages 13 formed in the base plate 7 is arranged at the same position as the corresponding one of the pressure chambers 4 for any of the pressure chambers 4A to 4D. Each of the third connecting passages 14 formed in the manifold plate 8 is arranged to be shifted toward an upper side with respect to the position of the nozzle 10, corresponding to the pressure chambers 4A to 4D. Here, an amount of shift between the third connecting passage 14 and the nozzle 10 is smaller than an amount of shift between the pressure chamber 4 and the nozzle 10. Accordingly, channels directed to be inclined from the pressure chambers 4A to 4D toward the corresponding nozzles 10 are formed.

The fifth pressure chamber 4E is slightly shifted upward with respect to the corresponding nozzle 10, and the sixth pressure chamber 4F is shifted further downward with respect to the corresponding nozzle 10. A seventh pressure chamber 4G is shifted further downward than the sixth pressure chamber 4F with respect to the corresponding nozzle 10. The third connecting passage 14 in the manifold plate 8, corresponding to the pressure chambers from the fifth pressure chamber 4E to the seventh pressure chamber 4G, are shifted downward (to a lower side) with respect to the corresponding nozzle 10. An amount of shift between the third connecting passage 14 and the nozzle 10 is smaller than an amount of shift between any one of the pressure chambers from the pressure chamber 4E to the pressure chamber 4G and the corresponding nozzle 10. Accordingly, channels directed to be inclined from each of the pressure chambers 4E to 4G toward the corresponding nozzles 10 are formed.

Sub ink supply passages 22 (auxiliary supply passages) each of which supplies the ink to one of the common liquid chambers 5 is formed in the space 21 between the first pressure chamber 4A of the first pressure chamber group 401 and the first pressure chamber 4A of the second pressure chamber group 402. As it has been described above, since the interval P3 of the space 21 is larger than the interval P1 of the nozzles 10, a sufficient area for forming the sub ink supply passage 22 is secured.

Figure 6:
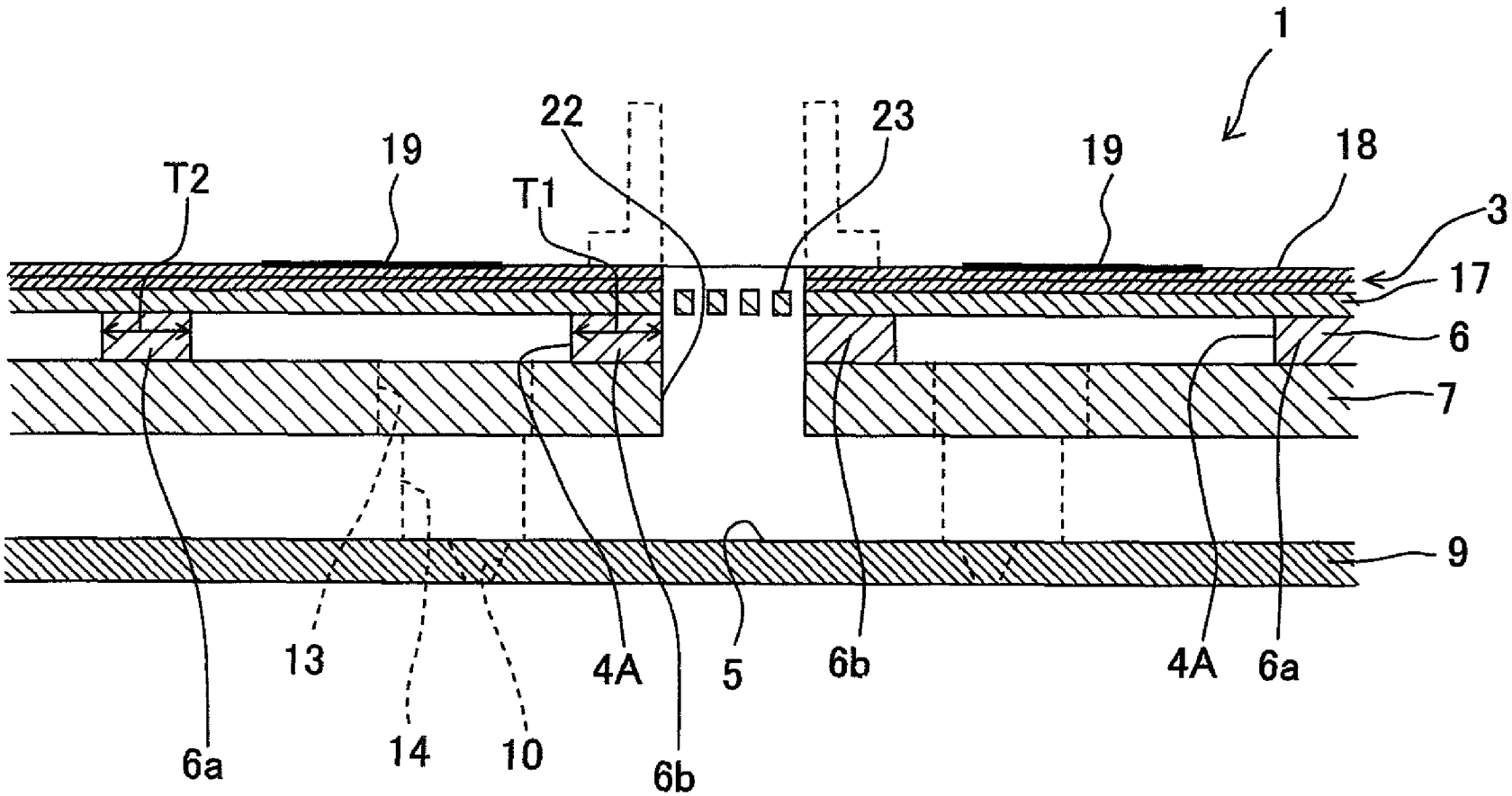
FIG. 6 is a cross-sectional view taken along a line VI-VI in FIG. 1.

FIG. 6 shows a cross-sectional view taken along a VI-VI line in FIG. 1. As shown in FIG. 6, each of the sub ink supply passages 22 is cut through the base plate 7, the cavity plate 6, the vibration plate 17, and the piezoelectric layers 18, and reaches the common liquid chamber 5 from an upper surface of the piezoelectric layer 18. Moreover, a filter 23 through which the ink flows is formed near an inlet opening of the sub ink supply passage 22, of the vibration plate 17.

In the first embodiment shown in FIG. 1, the four sub ink supply passages 22 are formed along Y direction. The two sub ink supply passages 22 arranged at both ends in Y direction and other two sub ink supply passages 22 arranged at an inner side thereof are mutually shifted (misaligned) in X direction corresponding to the positions of the pressure chambers 4 and the surface electrodes 19. Moreover, each of the sub ink supply passages 22 is positioned at a substantially central portion of one of the common liquid chambers 5 extended in X direction. In other words, a positional relationship of each of the sub ink supply passages 22 and the first and second pressure chamber group 401, 402 corresponding to the sub ink supply passage 22 is the same for all sub ink supply passages 22.

Since the sub ink supply passages 22 are formed, it is possible to supply the ink, from the ink supply source to the common liquid chambers 5, also through the sub ink supply passages 22. In other words, in the head 1 of the first embodiment, it is possible to supply in a large quantity the ink from the ink supply source, to the common liquid chamber 5 through the main ink supply passage 16 and the sub ink supply passages 22.

Moreover, as shown in FIG. 6, in the cavity plate 6, a thickness of a wall portion 6*a* between the adjacent pressure chambers 4 in the first pressure chamber group 401 (the second pressure chamber group 402) is T1, and a thickness of a wall portion 6*b* between the sub ink supply passage 22 and the first pressure chambers 4A adjacent to this sub ink supply passage 22 is T2. Here, T1 and T2 are same. Accordingly, a change in a volume of the first pressure chamber 4A adjacent to the sub ink supply passage 22, and a change in a volume of the other pressure chambers 4B to 4G becomes the same, and it is possible to achieve uniform jetting performance for all of the pressure chambers 4A to 4G.

According to the head 1 of the first embodiment, the first pressure chamber group 401 and the second pressure chamber group 402 are formed corresponding to each of the nozzle groups 101, and further, the space 21 is formed between the first pressure chamber group 401 and the second pressure chamber group 402. Since the sub ink supply passages 22 which supply the ink to the common liquid chambers 5 are formed in the spaces 21, it is possible not only to supply the ink from an end portion of the common liquid chambers 5 through the main ink supply passage 16, but also to supply the ink from a portion half way of each of the common liquid chambers 5 through the sub ink supply passages 22.

Consequently, the head 1 of the first embodiment is preferably applicable to a line head having a long nozzle row and a long common liquid chamber. In this case, even without increasing a size of the head by increasing a width of the common liquid chamber, it is possible to deliver the ink to all the nozzles. Moreover, since the positional relationship of each of the sub ink supply passages 22 and the first and second pressure chamber groups 401, 402 corresponding to the one of the sub ink supply passages 22 is the same for all, it is possible to keep an amount of ink which reaches the nozzles 10 of each of the nozzle rows 101.

Second Embodiment

Figure 7:
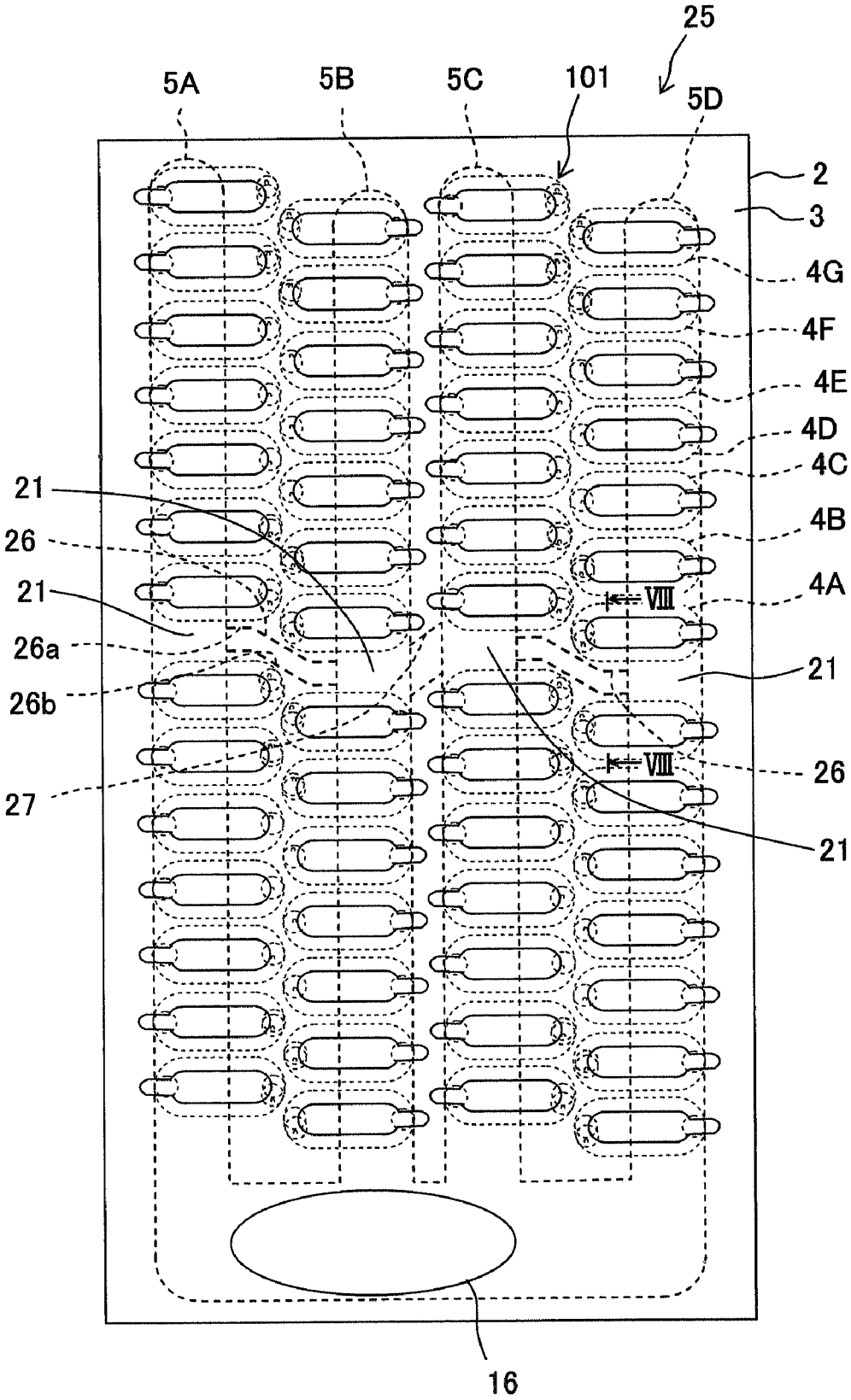
FIG. 7 is a plan view when a liquid droplet jetting head according to a second embodiment of the present invention is seen from a top.
Figure 8:
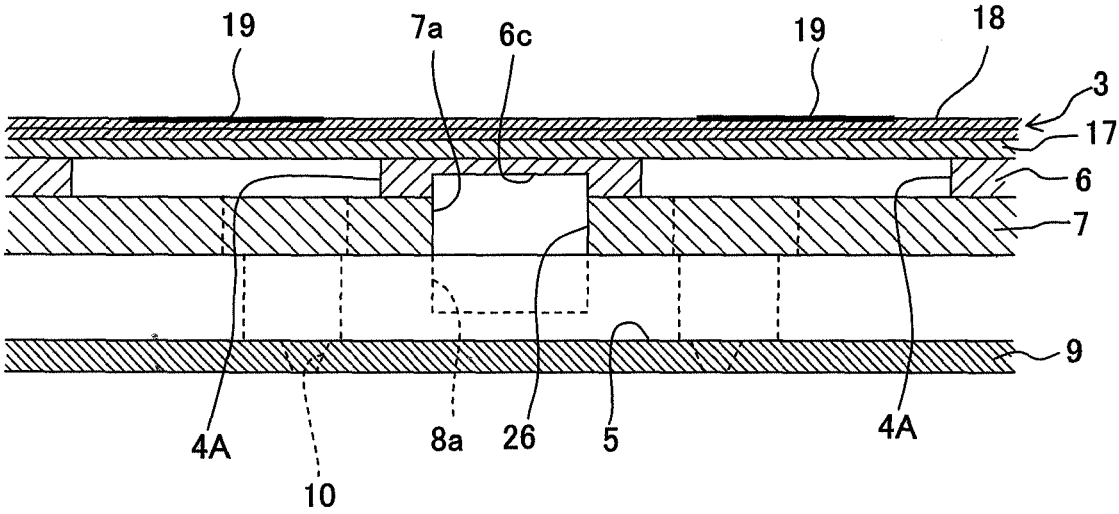
FIG. 8 is a cross-sectional view taken along a line VIII-VIII.

FIG. 7 is a plan view when a head 25 according to a second embodiment of the present invention is viewed from a top. FIG. 8 is a cross-sectional view taken along an VIII-VIII line in FIG. 7. Communication passages as auxiliary supply passages are provided to the head 25 of the second embodiment, instead of the sub ink supply passages 22 of the head 1 of the first embodiment. In the following description, each of the plurality of common liquid chambers 5 in FIG. 7 are called as a first common liquid chamber 5A, a second common liquid chamber 5B, a third common liquid chamber 5C, and a fourth common liquid chamber 5D in order from a left side. One of first communicating passages 26 which passes through a space 21 corresponding to the first common liquid chamber 5A and a space 21 corresponding to the second common liquid chamber 5B, and which makes communicate between the second common liquid chambers 5A and 5B is formed. Moreover, similarly, the other of the first communicating passages 26 which passes through a space 21 corresponding to the third common liquid chamber 5C and a space 21 corresponding to the fourth common liquid chamber 5D, and which makes communicate the third common liquid chamber 5C and the fourth common liquid chamber 5D is formed.

Each of the first communicating passages 26 is formed by a groove 8*a* opening on an upper surface of the manifold plate 8 at an area between the common liquid chambers 5 as shown in FIG. 8, a through hole 7*a* formed in the base plate 7, and a groove 6*c* opening on a lower surface of the cavity plate 6. Each of the first communicating passages 26 connects portions midway between the two common liquid chambers 5, and it is possible to make a large amount of ink reach up to corners of each common liquid chamber. Each of the first communicating passages 26 has a straight passage 26*a* arranged on both sides along Y direction and an inclined passage 26*b* corresponding to a shift in X direction of the two adjacent nozzle rows 101, and the ink flows smoothly between the common liquid chambers 5.

A second communicating passage 27 which passes through a space 21 of the corresponding second common liquid chamber 5B and a space 21 of the corresponding third common liquid chamber 5C, and which makes communicate the second common liquid chamber 5B and the third common liquid chamber 5C is formed. A channel cross-section of the second connecting passage 27 is larger than a channel cross-section of the first communicating passage 26, and a large amount of ink can be circulated between the second common liquid chamber 5B and the third common liquid chamber 5C. Moreover, the second communicating passage 27 is formed only by an inclined passage.

Moreover, the first communicating passage 26 is positioned at a substantially central portion of each common liquid chamber extended in X direction. A positional relationship of the first communicating passages 26, and the first and second pressure chamber groups 401, 402 corresponding to the communicating passage 26 is same for the all of the first communicating passages 26. Accordingly, it is possible to keep an amount of ink reaching the nozzles 10 of each nozzle row 101.

According to the head 25 of the second embodiment, the first pressure chamber group 401 and the second pressure chamber group 402 are formed corresponding to each nozzle row 101, and the space 21 is formed between the first pressure chamber group 401 and the second pressure chamber group 402. Since the first communicating passages 26 and the second communicating passage 27 which pass through the spaces 21, and which supply the ink to each of the common liquid chambers 5 are formed in the head 25, it is possible to supply the ink also from a half-way portion of each of the common liquid chambers 5 through the first communicating passage 26 and the second communicating passage 27. The head 25 of the second embodiment is applicable to a line head having a long nozzle row and a long common liquid chamber. In this case, it is possible to deliver the ink to all the nozzles without increasing a size of the liquid droplet jetting head by changing a width of the common liquid chamber.

Third Embodiment

Figure 9:
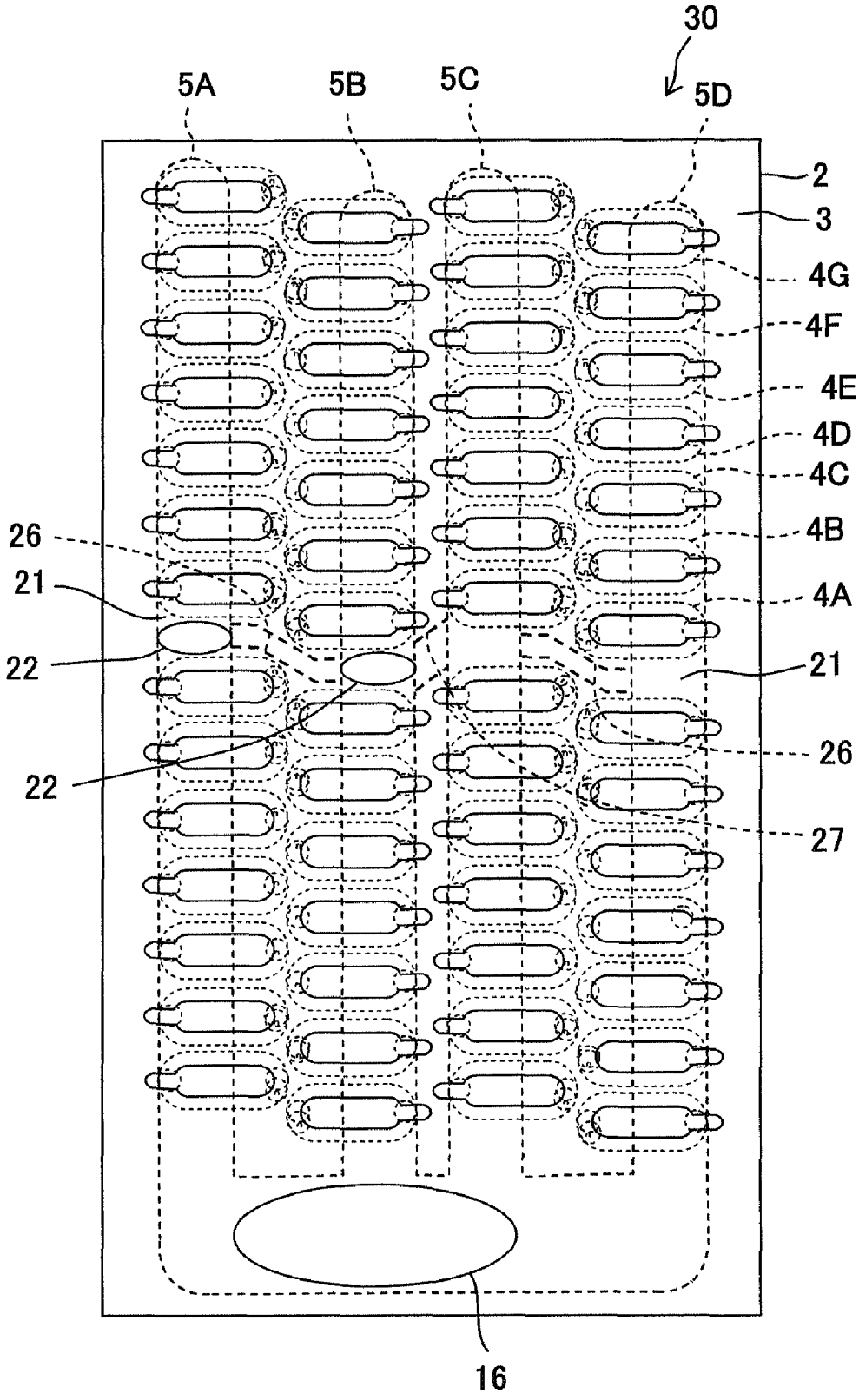
FIG. 9 is a plan view when a liquid droplet jetting head according to a third embodiment of the present invention is seen from a top.
Figure 10:
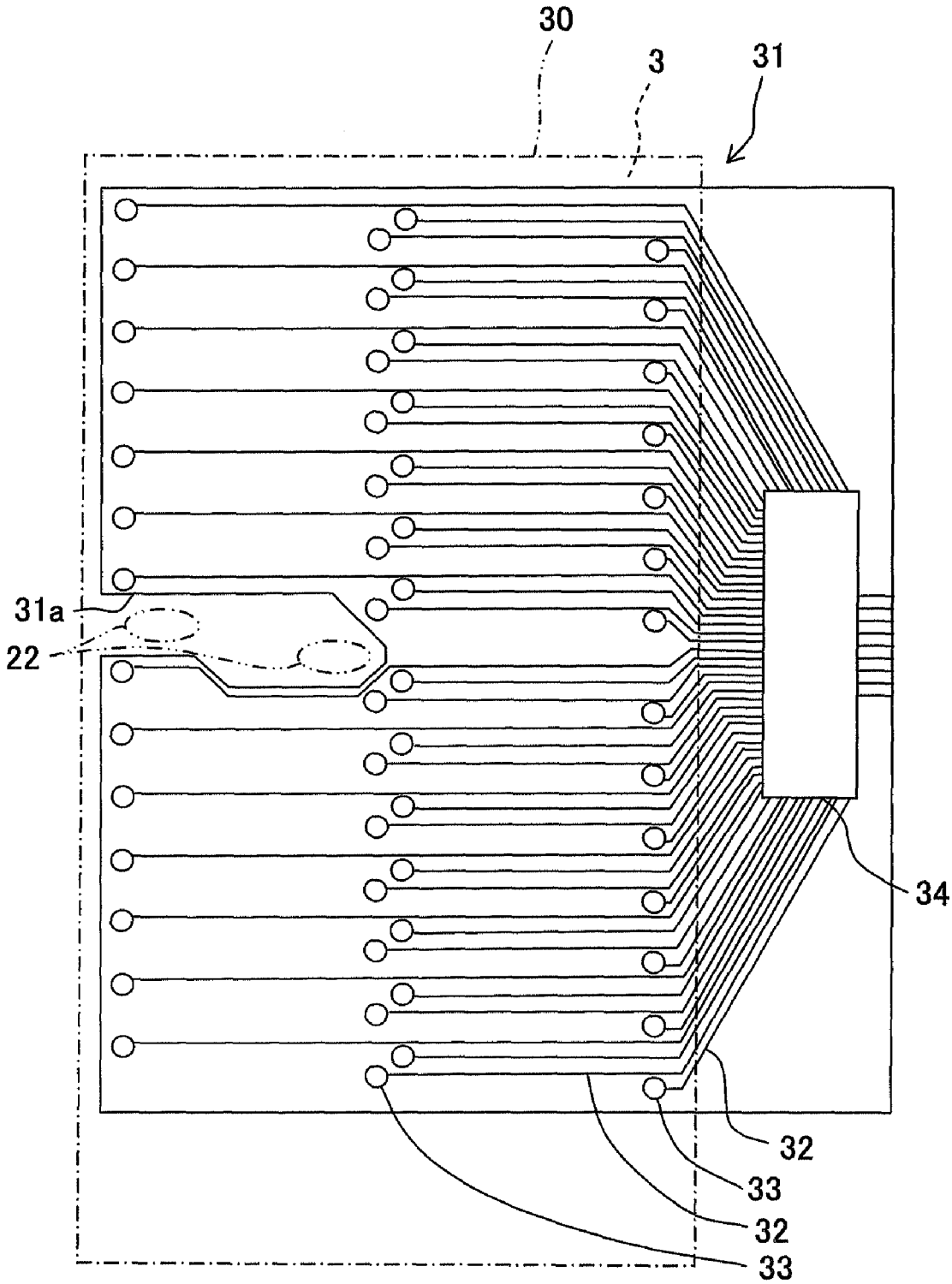
FIG. 10 is a plan view when a flexible circuit board to be connected to the liquid droplet jetting head is seen from a top.

FIG. 9 is a plan view when a head 30 according to a third embodiment of the present invention is viewed from a top. FIG. 10 is a plan view when a flexible wire 31 to be connected to the head 30 is viewed from a top. The head 30 of the third embodiment differs from the heads of the first embodiment and the second embodiment at a point that, the sub ink supply passage 22, and the first communicating passage 26 and the second communicating passage 27 are formed. The first communicating passage 26 and the second communicating passage 27 are formed similarly as in the second embodiment. The sub ink supply passage 22 is formed only for the first common liquid chamber 5A and the second common liquid chamber 5B. In the head 30 of the third embodiment, the ink circulates between the common liquid chambers 5 through the first communicating passage 26 and the second communicating passage 27. Further, since the ink is supplied from outside of the head 30 via the sub ink supply passage 22, it is possible to supply sufficiently a large amount of ink to all over the common liquid chambers 5, than in the head 1 and the head 25 of the first embodiment and the second embodiment.

The flexible wire 31 shown in FIG. 10 is arranged to cover the piezoelectric actuator 3, and is drawn in Y direction. A part of the flexible wire 31 is joined to the piezoelectric actuator 3. A resin sheet in the form of a flexible belt made of a synthetic resin such as polyimide, an electroconductive wire material made of copper foil arranged on a lower surface of the resin sheet, and a protective material covering the electroconductive wire material are stacked to form the flexible wire 31. Components such as electrode wires 32, electrode lands 33 provided at a front end of each of the electrode wires 32, and a driver IC 34 are formed on a lower surface of the resin sheet, and electrode wires 32 and the electrode lands 33 are formed by a photo resist (method). All the electrode wires 32 are connected to the driver IC 34, and a drive voltage is selectively supplied to each of the surface electrodes 35 of the piezoelectric actuator 3 via the electrode wires 32 and the electrode lands 33.

Opening portions (apertures) 31*a* are formed at positions, of the flexible wire 31, each corresponding to an inlet opening of each of the sub ink supply passages 22. Therefore, when the flexible wire 31 is arranged on the head 30, the flexible wire 31 does not block an upper side of the two sub ink supply passages 22 of the head 30. The opening portions 31*a* are formed to be pierced inward from a left end of the flexible wire 31 in FIG. 10, and the two sub ink supply passages 22 are not blocked by the flexible wire 31. The opening portions 31*a* may be formed corresponding to locations at which the sub ink supply passages 22 are formed. For instance, when the sub ink supply passage is formed only for the first common liquid chamber 5A, to correspond with this sub ink supply passage, by reducing a dimension of piercing inward from the left end of the flexible circuit board (flexible wire) in FIG. 10, one sub ink supply passage is not blocked.

Figure 11:
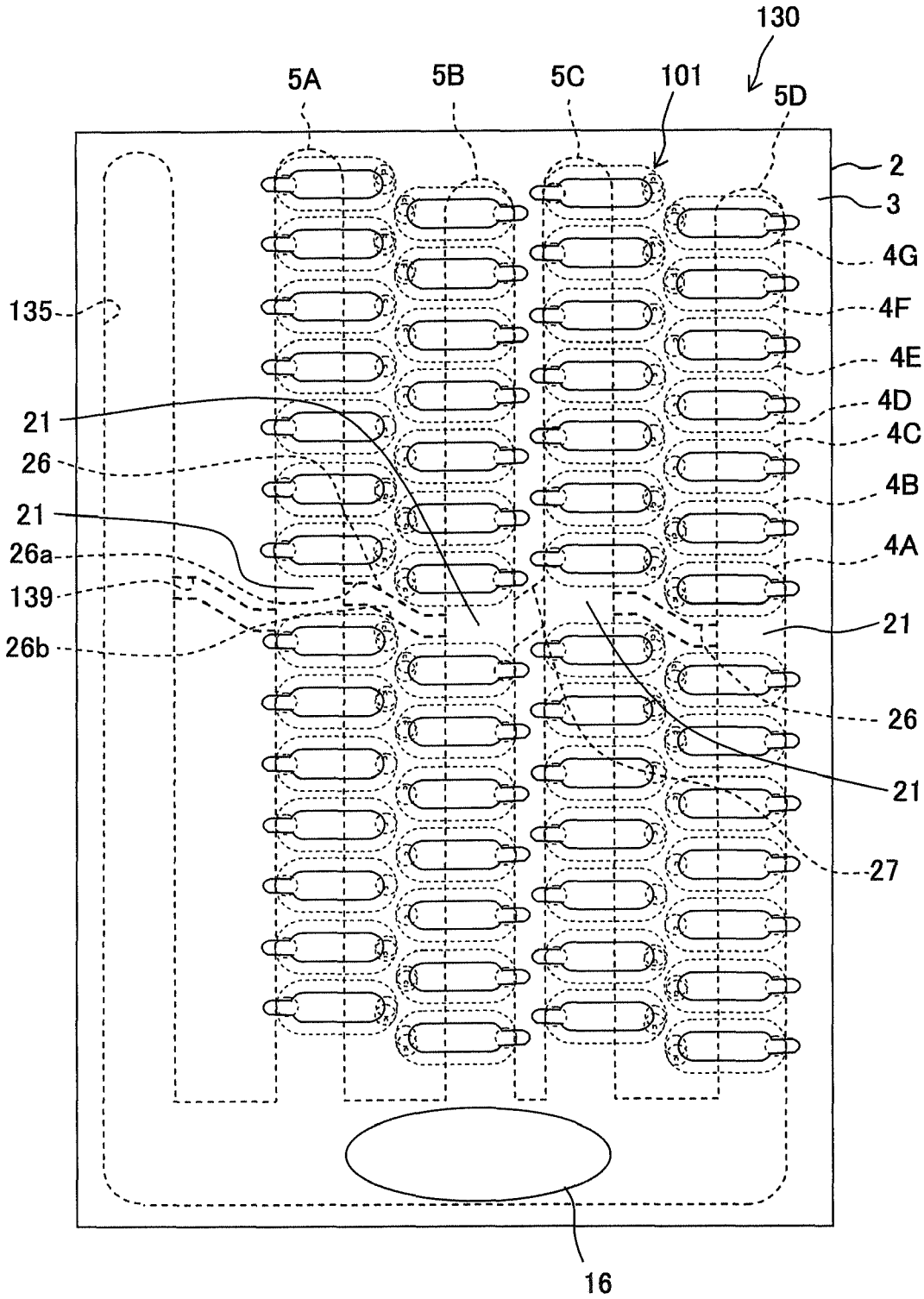
FIG. 11 is a plan view when a liquid droplet jetting head according to modification of the third embodiment of the present invention is seen from a top.

In the second and third embodiments as described above, the first and second passages are communicated with the common liquid chamber. In addition to this or in place to this, as shown in FIG. 11, the head 130 may include an ink-passage 135 extending parallel to the common liquid chambers 5A to 5D, and a communicating passage 139 through which the common liquid chamber 5A is communicated to the ink-passage 135. Similar to the second and third embodiments, the communicating passage 139 is formed at a portion corresponding to the space 21. Each of the common liquid chambers is directly communicated to the pressure chambers. On the other hand, the ink-passage 135 does not connected to the pressure chambers directly, and is used for supplying the ink to the common liquid chambers. In this case, a substantially amount of the ink can be supplied from the ink supply source to the common liquid chamber 5 through the ink-passage 135 and the communicating passage 139. The number of the ink-passage 135 and the arrangement of the ink-passage 135 can be determined arbitrary.

Fourth Embodiment

Figure 12A:
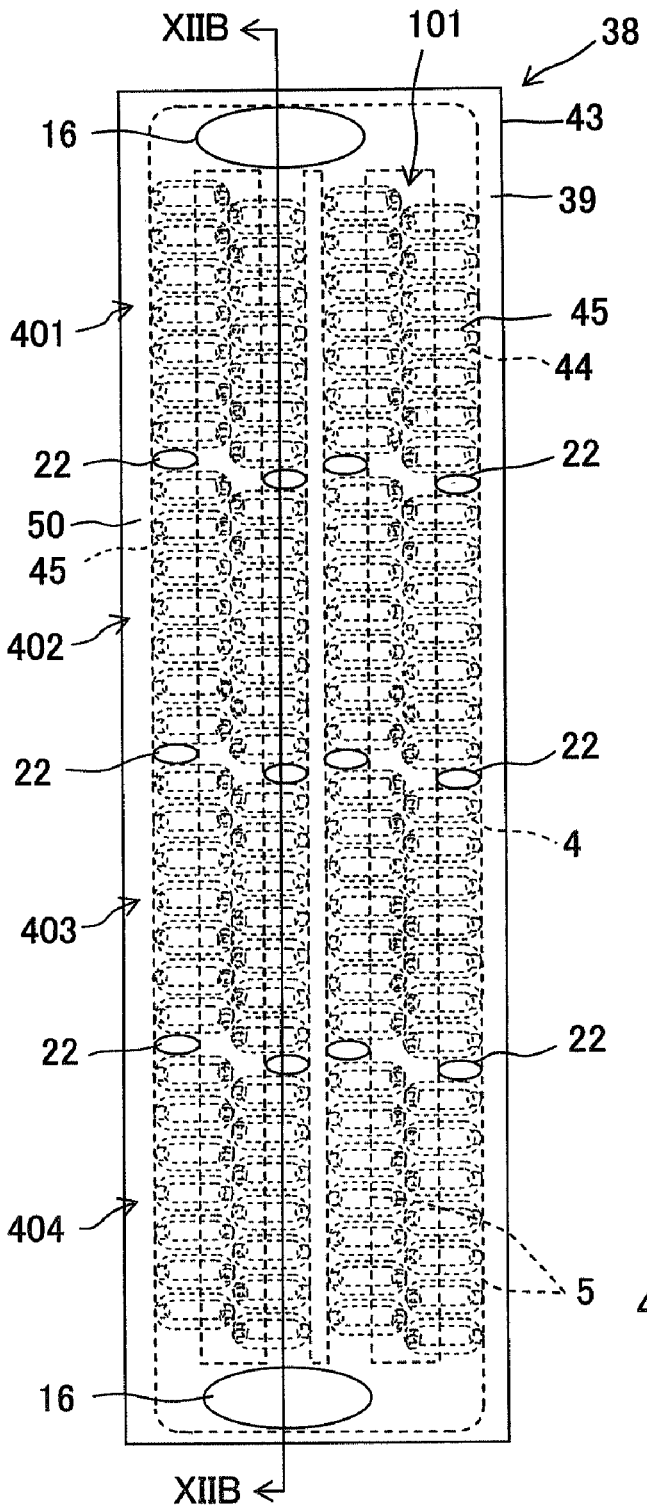
FIG. 12A is a plan view when a liquid droplet jetting head according to a fourth embodiment of the present invention is seen from a top.
Figure 12B:
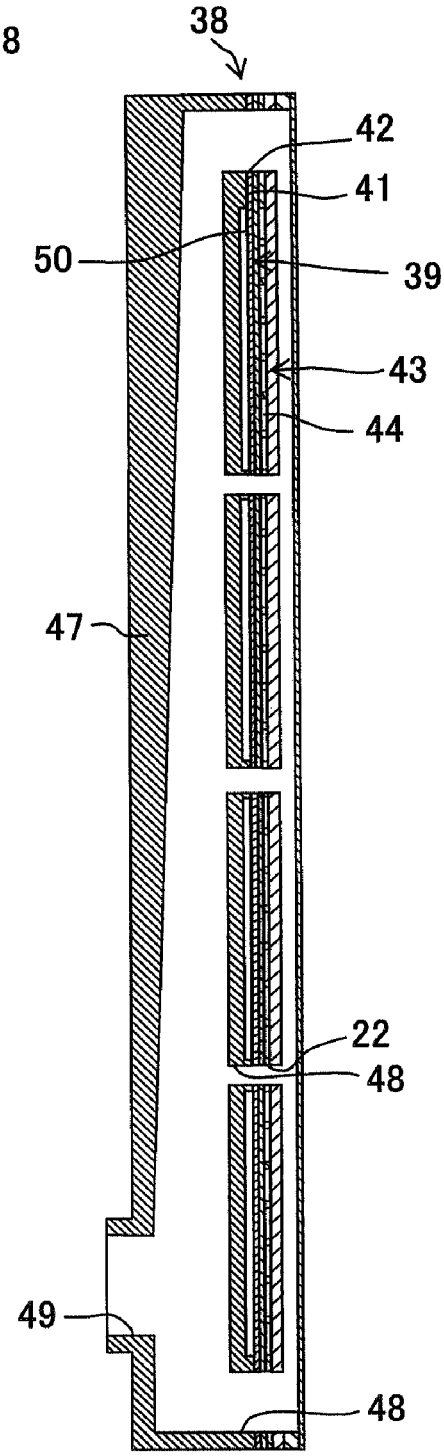
FIG. 12B is a cross-sectional view taken along a XIIB-XIIB line in FIG. 12A.
Figure 13:
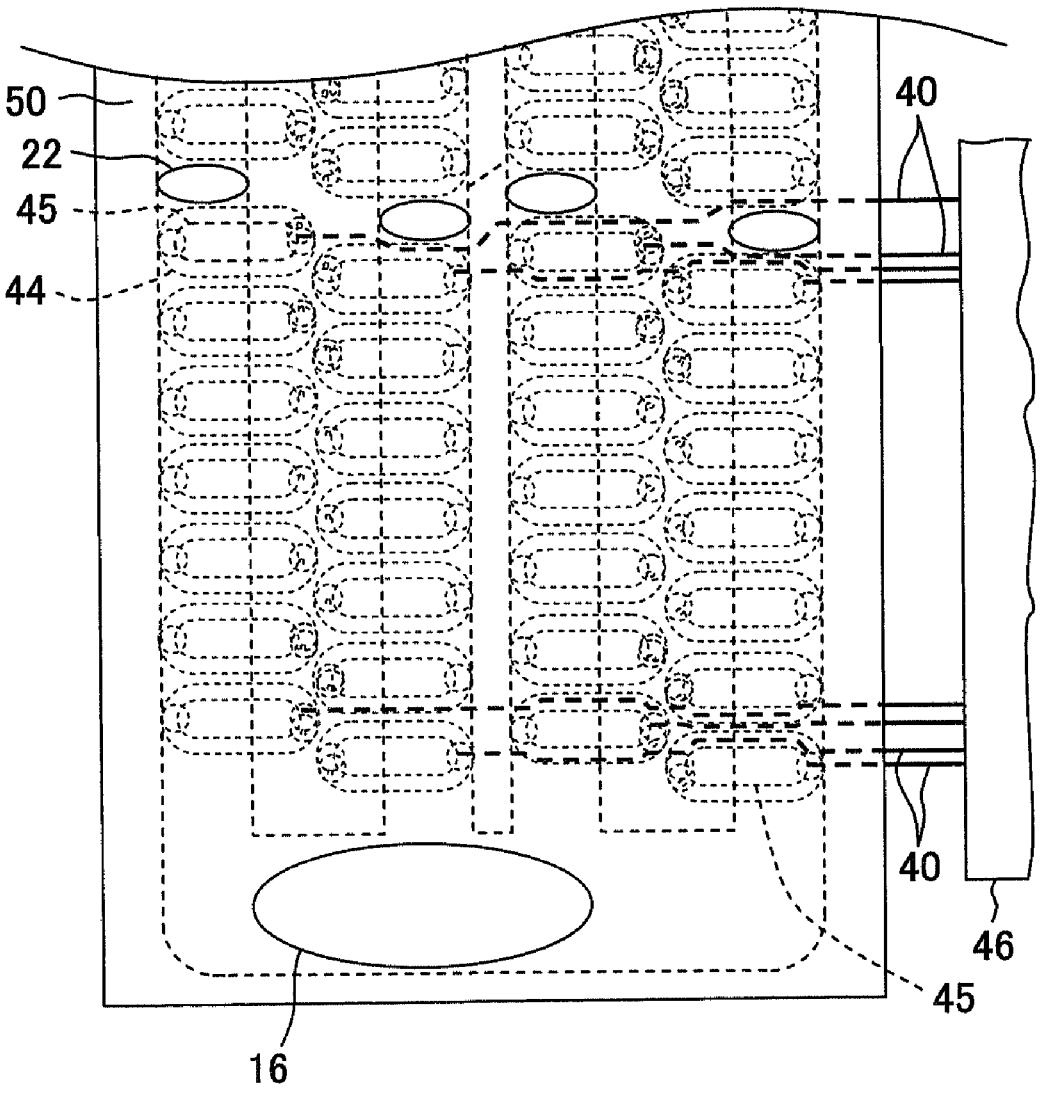
FIG. 13 is a detailed plan view in which, a part of the head 1 seen from the top is omitted.
Figure 14:
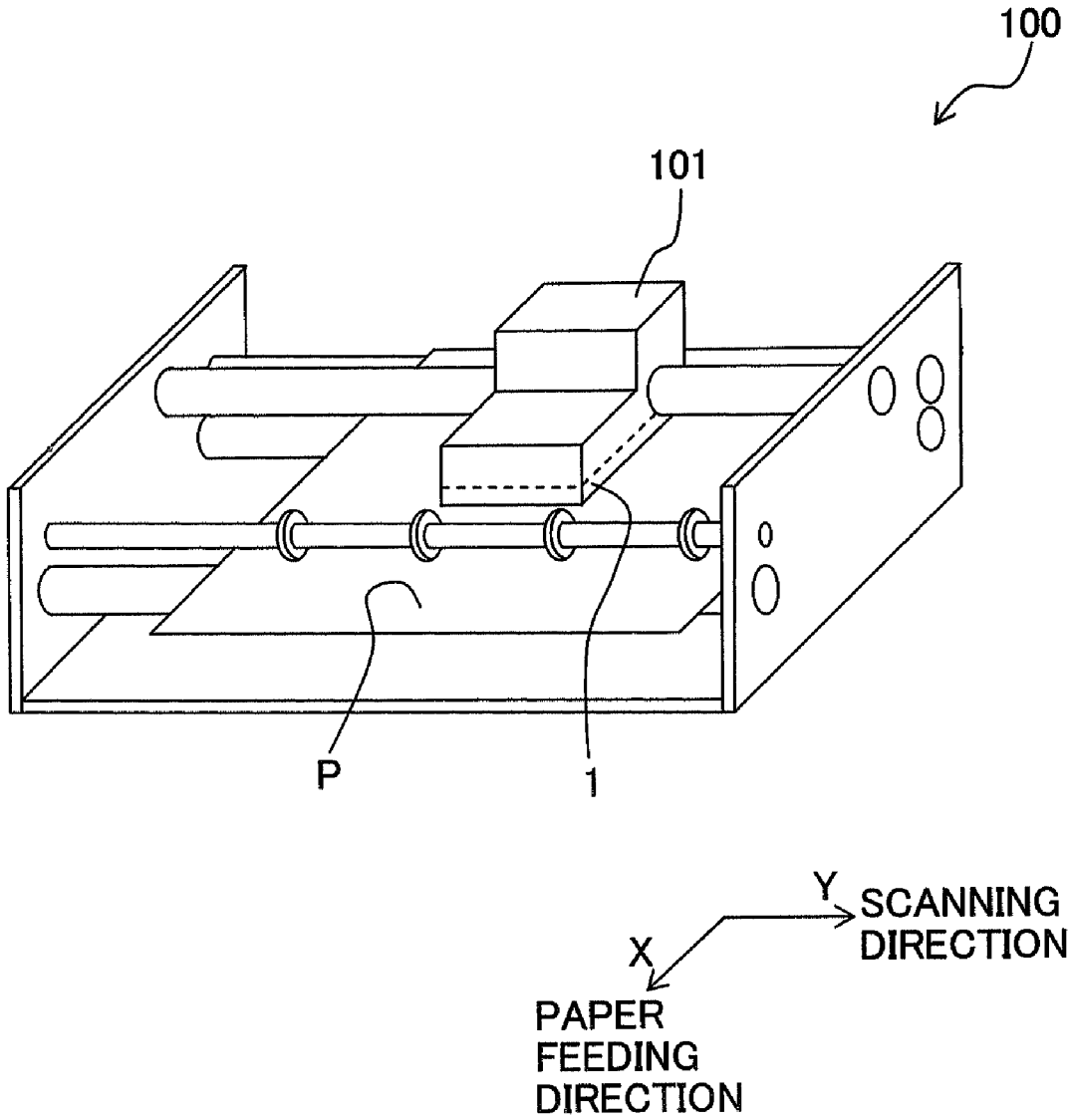
FIG. 14 is a perspective view of a ink-jet printer including the head of the present invention.

FIG. 11A is a plan view when a head 38 according to a fourth embodiment of the present invention is viewed from a top, FIG. 11B is a cross-sectional view with an ink casing 47 provided to the head 38, and FIG. 12 is a detailed plan view in which a part of the head 38 viewed from the top is omitted. The head 38 of the fourth embodiment differs from the head 1 of the first embodiment mainly at a point that, wire portions 40 to be connected to internal individual electrodes 45 inside a piezoelectric actuator 39 are provided. The piezoelectric actuator 39 of the fourth embodiment includes a rectangular shaped vibration plate 41, a plurality of stacked piezoelectric layers 42 which are formed to be rectangular shaped with substantially the same dimensions in a plan view, a common electrode 50 which is formed on an uppermost surface of the piezoelectric layers 42, and the internal individual electrodes 45 which are provided between the piezoelectric layers 42.

As shown in FIG. 11A, a plurality of pressure chamber groups 401 to 404 are formed corresponding to each of the nozzle rows 101 (four pressure chamber groups are formed in FIG. 11A). The sub ink supply passages 22 are provided in a space between the pressure chamber group 401 and the pressure chamber group 402, a space between the pressure chamber group 402 and the pressure chamber group 403, and a space between the pressure chamber group 403 and the pressure chamber group 404, respectively. Each of the internal individual electrodes 45 is formed to be slightly smaller than one of the pressure chambers 44 in a plan view, and has a long and slender shape in Y direction. Further, the internal individual electrodes 45 are arranged in a row corresponding to the pressure chambers 44. Moreover, as shown in FIG. 12, the wire portions 40 are extended toward one side in a long axis direction (Y direction) of the internal individual electrodes 45 from one end portion of each of the internal individual electrodes 45. The plurality of wire portions 40 are connected to a driver IC 46 which selectively supplies a drive voltage to the internal individual electrodes 45.

Consequently, the head 38 of the fourth embodiment does not need a flexible wire as compared with the heads in the embodiments described above. Moreover, the wire portions 40 extended from the internal individual electrodes 45 (internal drive electrodes) near the sub ink supply passages 22 are extended toward the driver IC 46 avoiding the sub ink supply passage 22, and the wire portions 40 are formed not to intersect with the sub ink supply passages 22.

As shown in FIG. 11B, the ink-casing 47 which covers the head 38 from the upper side is provided at an upper portion of the head 38. A plurality of supply passages 48 for supplying the ink to the sub ink supply passage 22 of the head 38 is formed at a lower side of the ink-casing 47, and an ink inlet 49 is formed at an upper portion of the ink-casing 47. Accordingly, the ink injected from the ink inlet 49 is accumulated in the ink-casing, and upon flowing to each of the sub ink supply passages 22 via one of the supply passages 48, the ink is supplied to each of the common liquid chambers 5.

The embodiments described above are examples to which the present invention is applied, and the present invention is not restricted to the embodiments described above. For instance, a type (mode) of the piezoelectric actuator, and an arrangement and the number of the electrodes etc. may be changed. The values of P1, P2, and P3 are disclosed for purposes of illustration and not limitation. Moreover, in the head of the embodiments, a piezoelectric method (type) which jets the ink droplets by using a vibration of a piezoelectric element is adopted. However, a thermal jetting type which makes jet ink droplets by generation of air bubble by a thermal energy may be adopted. Moreover, each head in the embodiments described above is a so-called serial head which is movably provided on the carriage. However, the head may be a so-called line head which does not move at the time of recording on a recording medium. The line head, in general, has a large number of nozzles and a nozzle row also becomes long. Therefore, the present invention is preferably applicable to the line head.

The present invention is applicable to a liquid droplet jetting head which is used in an apparatus such as a liquid droplet jetting apparatus. Further, the present invention is applicable to various liquid droplet jetting apparatuses which jet liquids of various types other than ink, on an object according to the intended use. For example, the present invention is also applicable to an apparatus which forms a wiring pattern by transferring on a substrate an electroconductive liquid in which metallic nano-particles are dispersed, an apparatus which manufactures a DNA chip by using a solution in which a DNA is dispersed, an apparatus which manufactures a display panel by using a solution in which an electro luminescence material such as an organic compound is dispersed, and an apparatus which manufactures a color filter for a liquid-crystal display by using a liquid in which pigments for color filter are dispersed.

What is claimed is:

1. A liquid droplet jetting head which jets droplets of a liquid, comprising:

a channel unit having:

a plurality of nozzles which are formed in the channel unit and which form a nozzle group arranged in a row in a first direction at a first interval;

a plurality of pressure chambers which are formed in the channel unit, each of which communicates with one of the nozzles and which form a first pressure chamber group and a second pressure chamber group, the first pressure chamber group including a first pressure chamber which is positioned nearest to the second pressure chamber group, the second pressure chamber group including a second pressure chamber which is positioned nearest to the first pressure chamber group, and the plurality of pressure chambers being arranged in a row in the first direction such that a gap between the first pressure chamber and the second pressure chamber is larger than the first interval;

a common liquid chamber which is formed in the channel unit, which communicates with the plurality of pressure chambers, and which is extended in the first direction corresponding to the plurality of pressure chambers arranged in the row;

a liquid supply passage which supplies the liquid to the common liquid chamber from outside of the channel unit; and an auxiliary supply passage which supplies the liquid to the common liquid chamber through the gap, and a pressure applying mechanism which applies a jetting pressure to the liquid in the plurality of pressure chambers;

wherein the pressure applying mechanism is a piezoelectric actuator which changes a volume of each of the pressure chambers independently, and which is joined to a surface of the channel unit; and wherein the piezoelectric actuator is arranged to overlap with the first and second pressure chamber groups so that the piezoelectric actuator straddles the first and second pressure chamber groups; and wherein the auxiliary supply passage is a sub supply passage which penetrates through the piezoelectric actuator to reach the common liquid chamber.

2. The liquid droplet jetting head according to claim 1;

wherein the channel unit includes a plurality of first walls each separating two adjacent pressure chambers among the pressure chambers, a second wall separating the sub supply passage and the first pressure chamber, and a third wall separating the sub supply passage and the second pressure chamber; and wherein a thickness of each of the first walls, a thickness of the second wall, and a thickness of the third wall are same.

3. The liquid droplet jetting head according to claim 1;

wherein the nozzle group is formed as a plurality of nozzle groups, and the plurality of nozzle groups are arranged at an interval in a second direction orthogonal to the first direction;

wherein the common liquid chamber, the first pressure chamber group, the second pressure chamber group, and the sub supply passage are formed as a plurality of common liquid chambers, a plurality of first pressure chamber groups, a plurality of second pressure chamber groups, and a plurality of sub supply passages, respectively, corresponding to the plurality of nozzle groups; and wherein a positional relationship among one of the sub supply passages, a first pressure chamber group among the plurality of the first pressure chamber groups, and a second pressure chamber group among the plurality of the second pressure chamber groups which are adjacent to the one of the sub supply passages, is same for all of the sub supply passages.

4. The liquid droplet jetting head according to Clam 1;

wherein the piezoelectric actuator includes a plurality of electric power supply terminals corresponding to the plurality of pressure chambers respectively; and wherein the liquid droplet jetting head further includes a flexible wire which includes a plurality of terminal electrodes which are connected to the plurality of electric power supply terminals respectively, and through which a driving electric power is supplied to the piezoelectric actuator; and wherein an opening which maintains the sub supply passage to be opened is formed in the flexible wire at a position at which the opening overlaps with the sub supply passage.

5. The liquid droplet jetting head according to claim 1;

wherein the piezoelectric actuator includes a plurality of internal drive electrodes corresponding to the plurality of pressure chambers respectively, and a plurality of wires which are formed inside the piezoelectric actuator, and through which a driving electric power is supplied to the internal drive electrodes; and wherein the plurality of wires is extended in an area at which the sub supply passage is absent.

6. The liquid droplet jetting head according to claim 1;

wherein the nozzle group is formed as a plurality of nozzle groups arranged to be separated and away from each other in a second direction orthogonal to the first direction;

wherein the common liquid chamber, the first pressure chamber group, and the second pressure chamber group are formed as a plurality of common liquid chambers, a plurality of first pressure chamber groups, and a plurality of second pressure chamber groups, respectively, corresponding to the nozzle groups; and wherein the auxiliary supply passage is a communicating passage via which two common liquid chambers among the common liquid chambers are communicated.

7. The liquid droplet jetting head according to claim 6;

wherein two adjacent nozzle groups in the second direction, among the nozzle groups, are arranged to be shifted from each other in the first direction; and wherein two common liquid chambers among the common liquid chambers and corresponding to the two nozzle groups are communicated via the communicating passage, and the communicating passage has an inclined passage corresponding to the shift in the first direction, between the nozzle groups.

8. The liquid droplet jetting head according to claim 6;

wherein a positional relationship among the communicating passage, one first pressure chamber group which belongs to the first pressure chamber groups and which corresponds to the communicating passage and one nozzle group of the nozzle groups, and one second pressure chamber group which belongs to the second pressure chamber groups, which is located adjacent to the one first pressure chamber group, and which corresponds to the communicating passage and the one nozzle group, is same for all of the nozzle groups.

9. The liquid droplet jetting head according to claim 1;

wherein an interval between two adjacent pressure chambers among the pressure chambers belonging to the first pressure chamber group or the second pressure chamber group is narrower than the first interval.

10. The liquid droplet jetting head according to claim 1;

wherein the channel unit is elongated in the first direction.

11. The liquid droplet jetting head according to claim 1;

wherein the pressure chambers are arranged in a plane direction in the channel unit, wherein the piezoelectric actuator is arranged to entirely cover the pressure chambers in the plane direction; and wherein the sub supply passage extends in a direction crossing the plane direction and is introduced to the common liquid chamber from a side, of the piezoelectric actuator, not facing the channel unit.

12. The liquid droplet jetting head according to claim 1;

wherein the channel unit includes a nozzle plate in which the nozzles are formed, and a cavity plate in which the pressure chambers are formed; and wherein the nozzle plate, the cavity plate and the pressure applying mechanism are stacked in this order.

13. The liquid droplet jetting head according to claim 1;

wherein the pressure chambers and the common liquid chamber are arranged between the nozzles and the pressure applying mechanism.

* * * * *